US009962806B2

(12) United States Patent
Kingsland et al.

(10) Patent No.: US 9,962,806 B2
(45) Date of Patent: May 8, 2018

(54) BLADE SHARPENING DEVICES, BLADE SHARPENING SYSTEMS AND METHODS OF SHARPENING A BLADE

(71) Applicant: The Shop, Inc., Bonners Ferry, ID (US)

(72) Inventors: Mitchell J. Kingsland, Sandpoint, ID (US); Fred L. Kingsland, Bonners Ferry, ID (US)

(73) Assignee: The Shop, Inc., Bonners Ferry, ID (US)

( * ) Notice: Subject to any disclaimer, the term of this patent is extended or adjusted under 35 U.S.C. 154(b) by 740 days.

(21) Appl. No.: 14/485,440

(22) Filed: Sep. 12, 2014

(65) Prior Publication Data

US 2016/0074991 A1 Mar. 17, 2016

(51) Int. Cl.
*B24B 41/06* (2012.01)
*B24D 15/06* (2006.01)

(52) U.S. Cl.
CPC ..... *B24B 41/066* (2013.01); *B24D 15/06* (2013.01)

(58) Field of Classification Search
CPC ..... B24D 15/06–15/105; B24B 3/586; B24B 41/066
See application file for complete search history.

(56) References Cited

U.S. PATENT DOCUMENTS

2006/0211348 A1* 9/2006 Hyde ..... B24B 3/38 451/367
2011/0159791 A1* 6/2011 Heng ..... B24B 3/546 451/371
2014/0342644 A1* 11/2014 Hasegawa ..... B24D 15/08 451/369
2015/0140909 A1* 5/2015 Stanley ..... B24D 15/06 451/371

* cited by examiner

*Primary Examiner* — Christopher M Koehler
*Assistant Examiner* — Henry Long
(74) *Attorney, Agent, or Firm* — Wells St. John P.S.

(57) ABSTRACT

A blade-sharpening device including a plate having a base and a raised feature. At least one force applicator applies force to a blade placed over the plate deflecting the front and back of the blade toward the plate. A gap may be maintained between the front of the blade and the plate. A blade sharpening system including a blade to be sharpened associated with a support plate. The blade is pre-tensioned over a contact position on the plate. The system includes a sharpening surface for contacting a surface of the blade while the blade is held in a pre-tensioned position. A method of sharpening a blade by providing a blade to be sharpened attached to a surface of the blade to a sharpening surface.

9 Claims, 7 Drawing Sheets

BLADE SHARPENING DEVICES, BLADE SHARPENING SYSTEMS AND METHODS OF SHARPENING A BLADE

TECHNICAL FIELD

The invention pertains to blade sharpening devices and sharpening systems that hold the blade in a pre-tensioned position for sharpening. Methods include holding the blade in a pre-tensioned position while the blade is contacted to a sharpening surface.

BACKGROUND OF THE INVENTION

Clippers and trimmers are configured to utilize two opposing blades. The two blades have multiple teeth along the cutting edge of each blade and the teeth on one of the two blades must contact the teeth of the opposing blade for proper function. The clipper or trimmer assembly holds tension on the blades utilizing spring tension or force applied to the assembly such that there is pressure between the teeth of the opposing blades. Conventional sharpening techniques typically involve contacting the blades with a sharpening surface. However, during conventional sharpening, the blades are not pre-tensioned. The conventional techniques can apply pressure and generate heat that can result in an irregular grind. Since conventional sharpening does not simulate the blade configuration that occurs in the clipper or trimmer device, the sharpening may result in loss of contact of the blades during use such that the blades do not function properly.

It is desirable to develop alternate devices and techniques for sharpening of clipper blades and trimmer blades.

SUMMARY OF THE INVENTION

In one aspect, the invention includes a blade-sharpening device. The device includes a support plate having a planar upper surface and a raised feature that protrudes upward from the upper surface. At least one force applicator is configured to apply force to a blade placed over the support plate and in contact with the raised feature, thereby pre-tensioning the blade. Applied force deflects the front edge and the back edge of the blade toward the support plate, curving the blade from front to back. A gap may be maintained between the front edge of the blade and the front upper surface of the support plate.

In one aspect, the invention encompasses a blade sharpening system. A blade to be sharpened is supported by a blade support plate. The blade support plate has a raised upper surface that contacts the blade at a contact position on the upper surface. The blade maintained in a pre-tensioned configuration over the contact position, with the front edge and the back of the blade being deflected toward the support plate. The system includes a sharpening surface for contacting the bottom of the front edge of the blade during sharpening.

In one aspect, the invention encompasses methods of sharpening a blade. The methods include providing a blade to be sharpened attached to a support plate, the blade being pre-tensioned over a fulcrum comprised by the support plate with the front edge and the back edge of the blade being defected toward the support plate. A gap may be maintained between the front edge of the blade and the support plate. The methods further include holding the support plate and blade with a holder and, utilizing the holder, contacting a surface of the blade to a sharpening surface while the blade is held in a pre-tensioned configuration, the gap being maintained during the sharpening.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The invention is generally directed to blade sharpening devices and systems that pre-tension a blade for sharpening and methodology for utilization of such devices. Specifically, the methods and devices of the invention hold a blade of a clipper, a shearer or a trimmer in a pre-tensioned configuration for sharpening at a position which produces a suitable shape or profile for clipper functionality as compared to conventional sharpening devices.

When assembled, a clipper blade functions as multiple scissors. A bottom surface of the blade is "ground" during sharpening resulting in edges of the teeth becoming sharp. The front of the "comb" (lower) blade can be rounded dull to prevent cutting of skin. The tips of cutter (upper) blade are sharpened points that do not protrude beyond the tips of the comb blade. A hollow grind is utilized to ensure that the cutting blade tips always touch the comb blade surface. Spring pressure within the clipper device can flatten out the cutter blade and comb blade. The devices and techniques of the invention utilized during blade sharpening utilize pre-tensioning of a blade prior to hollow grinding.

Figure 1:
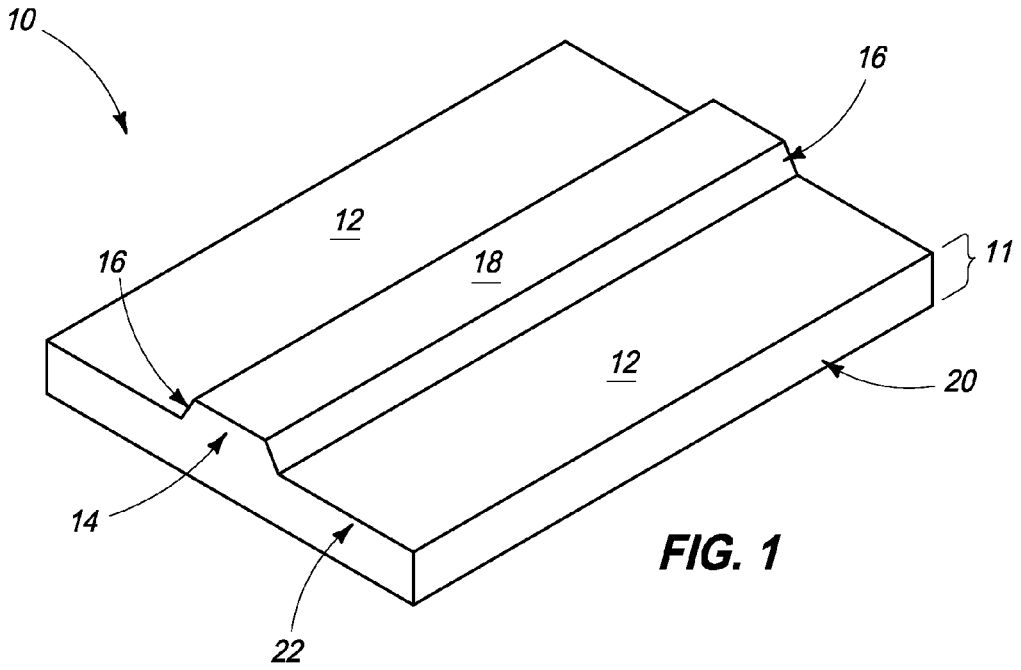
FIG. 1 depicts a blade support plate according to one aspect of the invention.

Devices of the invention are described generally with respect to FIGS. 1-7. Referring initially to FIG. 1, an example support plate 10 of a sharpening device is illustrated. Support plate 10 can comprise a base 11 and a raised feature 14. Base 11 can have an upper surface 12 with raised feature 14 protruding upward from the base upper surface in the orientation of the plate illustrated. Raised feature 14 can have an upper surface 18 which may be planar in specific embodiments of the invention, and opposing front and back sidewalls 16 that can be angled as shown.

As used herein, elevation-related terms such "top", "bottom", "upper", "lower" and the like are relative to the orientation shown in FIGS. 1-7. It is noted that the plate as shown in FIG. 1 is inverted during blade sharpening such that the base of the plate is oriented above the raised feature.

Base 11 can have a front 20 and an opposing back (not visible in FIG. 1) with a length of the plate being defined as the distance between the front an the back of the base. A width of the plate is defined as being a distance between opposing sides 22 of the base.

Support plate 10 is not limited to one specific size. The size of the plate may be configured specifically for a particular blade. The width of the plate can be, for example, from about 1.0 inch to about 4.0 inches. The length of the plate can be, for example, from about 0.5 inch to about 3.0 inches. An overall thickness of the plate, including the raised feature, can be from about 0.125 inch to about 2.0 inches. Example preferred support plate sizes can be 2"×2.5"×0.125", or 1"×1.5"×0.375" (length×width×thickness).

Although raised feature 14 is shown to have angled sidewalls 16, the sidewalls can alternatively be vertical. Additionally, upper surface 18 of the raised feature can be pre-tensioned, pointed at an apex, or domed; or can be planar and at an angle such that one of opposing sidewalls 16 is shorter than the other. In the configuration shown, raised feature is continuous and extends across an entirety of the width of the support plate. However, it is to be understood that the invention contemplates the raised feature comprising intermittent segments and/or extending less than a full width of the plate.

A height of raised feature 14 above surface 12 of base 11 is not limited to a particular value. The height of the raised feature may be specific to a particular blade for attaining desired contact points between the blade and the support plate when the blade is tensioned (discussed below).

Base portion 11 and raised feature 14 can be formed of the same material or from differing materials. Additionally, each of the raised feature and the base can independently comprise a single material or may comprise two or more materials. Materials from which the base and/or the raised feature can be formed include but are not limited to metals, metal alloys, steel, aluminum, wood, plastic, and/or rubber. In particular aspects, the raised feature can comprise a magnetic material.

In the depiction of FIG. 1, raised feature 14 is shown to be in a fixed position. However, the invention contemplates utilization of a raised feature that pivots from front to back, or that is compressible on each side. The location of the raised feature with respect to the front and back of the plate is not limited to the central position shown in FIG. 1. The position of the raised feature can be moved forward or backward over the base so long as there is a portion of the base extending in front of and behind the raised feature. The raised feature can optionally be spring loaded or adjustable in height.

Figure 2:
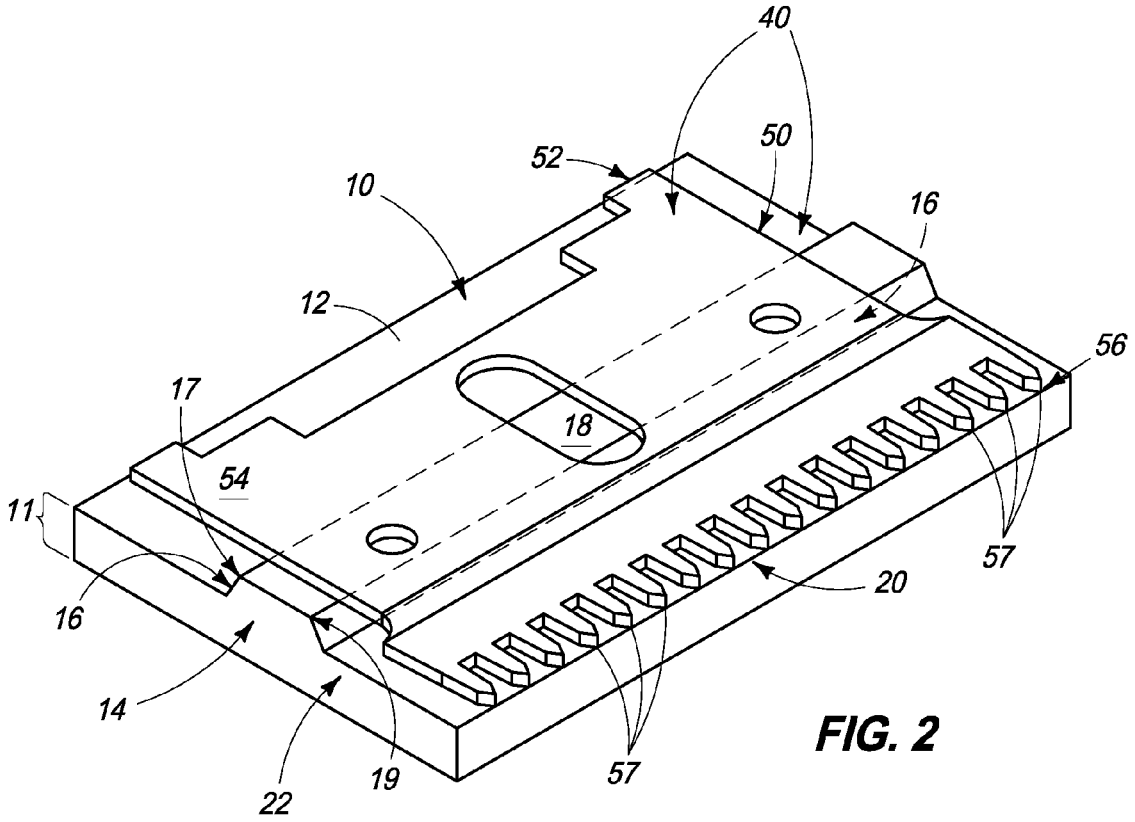
FIG. 2 illustrates an example blade/support plate combination having a blade positioned over the support plate of FIG. 1, prior to tensioning.

With reference to FIG. 2, such depicts an example blade 50 in association with a support plate 10 to form part of a blade/support plate assembly 40. The example blade in FIG. 2 is a comb blade, the lower blade in the pair of blades used in a clipper. The invention includes utilization of support plate 10 in conjunction with cutter blades, the upper blade in a clipper. It is noted that the assembly illustrated in FIG. 2 depicts vertical positioning of the blade relative to the plate prior to any pre-tensioning force application (discussed below). The depicted blade is but one example of a multitude of blades that can be sharpened utilizing devices and methodology of the invention. Blade 50 is not limited to any particular size, thickness or shape. Blade 50 can have any of a variety of shapes and sizes available for use with differing clippers or trimmers.

Blade 50 is preferably aligned over support plate 10 such that a plurality of teeth 57 along a blade front edge 56 is aligned with the front 20 of support plate 10. Sides of the blade may extend to the sides 22 of the support plate, can extend beyond the sides of the support plate, or can be inset as illustrated. A back of the blade can align with the back of plate 10, can extend beyond the back edge of the support plate, or can be inset.

The openings through blade depicted in FIG. 2 can be present to attach or align the blade within a clipper or trimmer and can fabricated by the blade manufacturer uniquely to the particular blade and clipper/trimmer. However, the invention contemplates use of one or more of such pre-fabricated openings along for tensioning the blade for sharpening. Alternatively, one or more additional openings can be introduced through blade 50 in particular aspects of the invention. In some aspects no openings through the blade are utilized with respect to the support plate or during the sharpening.

It is noted with reference to FIG. 2 that corners 17, 19 of raised surface 14 are formed where each of the front and back sidewalls 16 meet the upper surface 18. In the embodiments of the invention where corners 17 and 19 are present, it is preferable that the blade is positioned to contact only one of these corners (after tensioning of the blade).

Figure 3A:
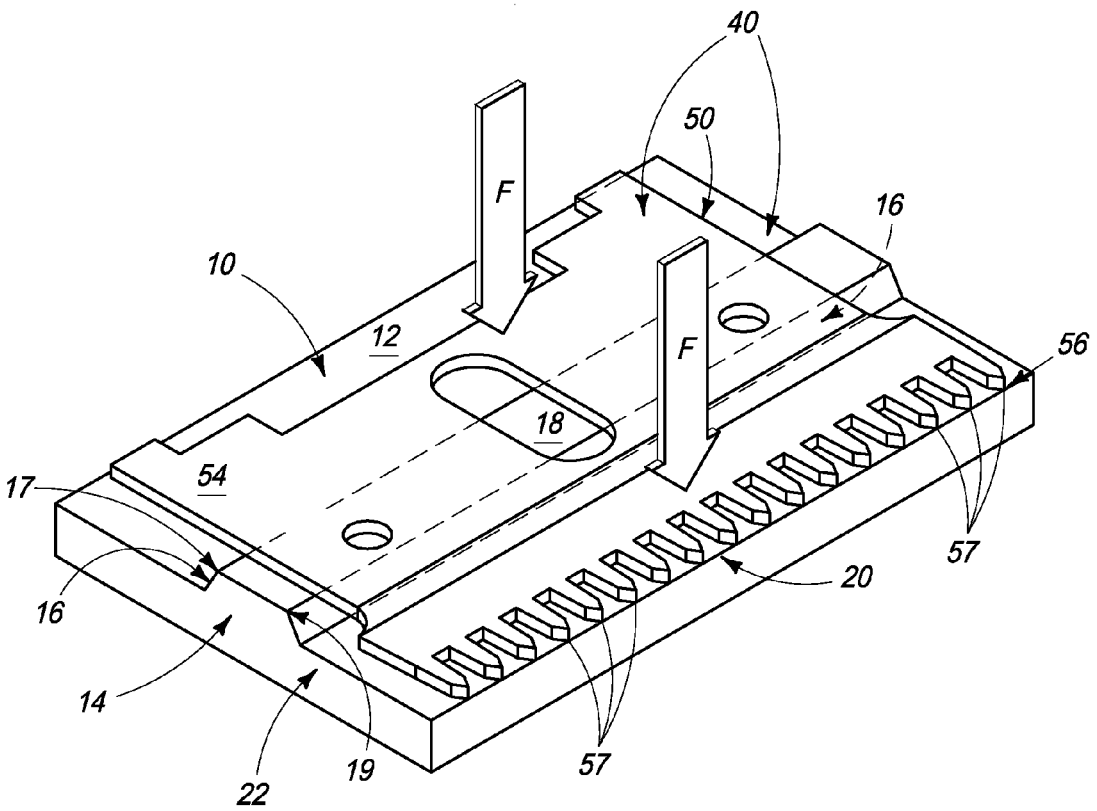
FIG. 3A illustrates force application to the blade in the blade/support plate combination of FIG. 2.

Referring next to FIG. 3A, such illustration depicts generally, the positions of force application to the blade to pre-tension the blade for sharpening. Force arrows "F' are used to show that one force is applied to the blade behind the position of the raised feature of support plate 11. This force can be applied anywhere along blade 50 behind the raised feature, including but not limited to the back edge of the blade. A second force is applied to the blade in front of the raised feature. For proper tensioning of the blade in accordance with the invention, mechanical force by should preferably not be applied directly along the front edge or tooth area of the blade since contact at the front of the blade can possibly distort the front of the blade.

Figure 3B:
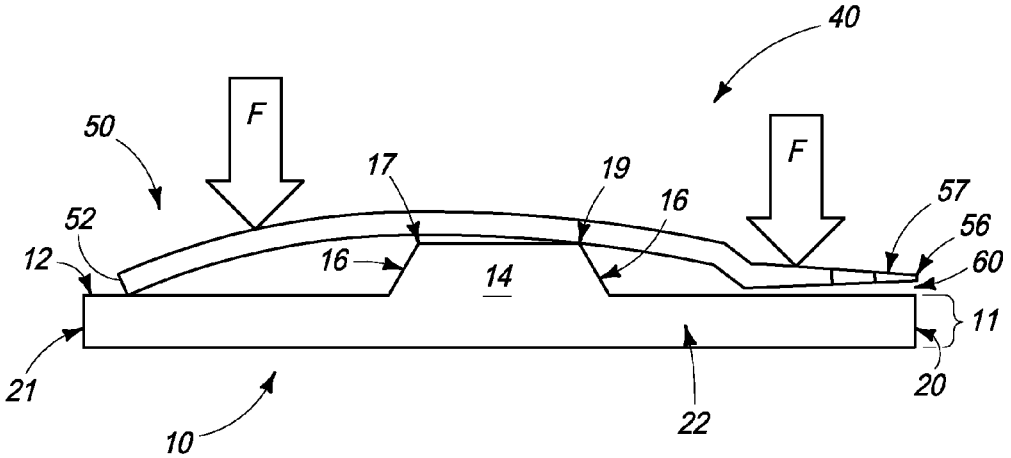
FIG. 3B illustrates deflection of a blade over a support plate in accordance with one aspect of the invention.

FIG. 3B represents the effects of the application of force to the blade in accordance with the invention. It is noted that in assembly 40, upon the application of force the blade makes a single contact with front corner 19 of the raised feature in the embodiment shown. However, the contact point between the blade and the raised feature may alternatively be along back corner 17. The applied force also preferably creates a contact between the back 52 of blade 50 and upper surface 12 of the base portion of the support plate. Additionally, a gap 60 can be maintained between front edge 56 of the blade and the front 20 of the support plate. This gap can be important for proper profiling and/or sharpening of blade 50.

As illustrated in FIG. 3B, the applied forces "F" can create curvature of blade 50 that extends along the length of the blade. The amount of curvature illustrated is exaggerated for ease of description. In some instances, the blade may only be slightly curved. For blades that are curved prior to any application of force, the applied force can flatten the blade over the plate. The applied force induces deflection of the blade relative to its original configuration such that the front and the back of the blade are deflected toward the base 11 of support plate 10. The extent of curvature or flattening can be customized to a particular blade by adjusting the features of raised feature 14 (height, width, shape, pivoting and/or compressibility) and/or the strength of the applied force.

In some aspects, at least an upper portion of raised feature 14 can comprise rubber to conform the contact point to the curvature of the blade. In another aspect, at least an upper portion of the raised feature can be magnetic. The magnetic upper portion of raised feature 14 can be positioned proximate a magnetic component attached to an undersurface of blade 50 with like poles facing such that there is a repelling force between the blade and the raised feature. Such configuration can assist in pre-tensioning of the blade and achieving a single contact point between the raised feature and the blade.

The illustrated forces "F" can be applied utilizing one or more force applicators. Such applicators can include magnets, magnetic force or pull, and/or mechanical devices including one or more threaded fasteners, one or more clamping devices, or adhesive between the blade and the support plate, or combinations thereof. The exact type(s) and positioning of applicators may be determined by the particular blade to be sharpened, considering such blade aspects as shape, materials, flexibility, strength, thickness etc. Where one or more threaded fastener is utilized, appropriate openings can be introduced through the blade to allow the fastener(s) to pass through the desired position(s) on the support plate and into a threaded hole in the blade.

Figure 3C:
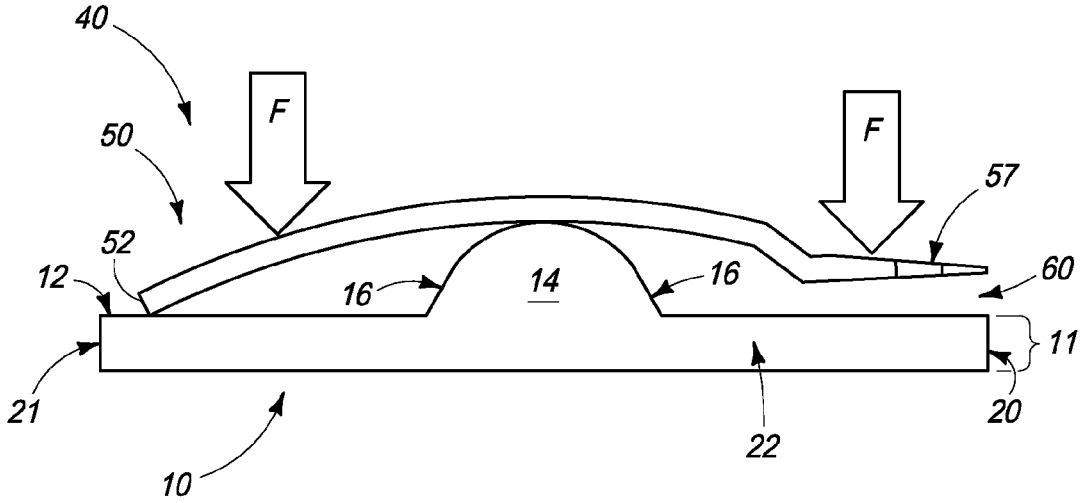
FIG. 3C illustrates a blade/support plate assembly in accordance with one aspect of the invention.

With respect to FIG. 3C, such illustrates an embodiment of the invention where upper surface 18 of raised feature 14 of the support plate is curved or domed. Such shape can facilitate a single "fulcrum" along the uppermost point of the surface around which blade 50 can be pre-tensioned by application of force.

Figure 4:
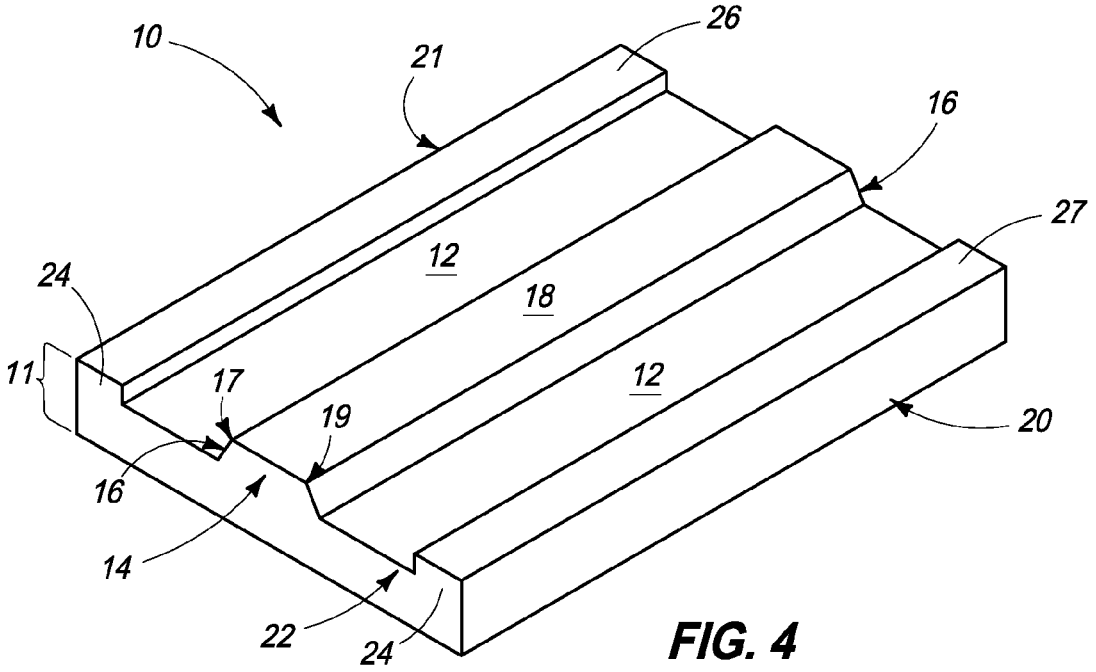
FIG. 4 depicts an alternate embodiment of a support plate in accordance with another aspect of the invention.
Figure 5:
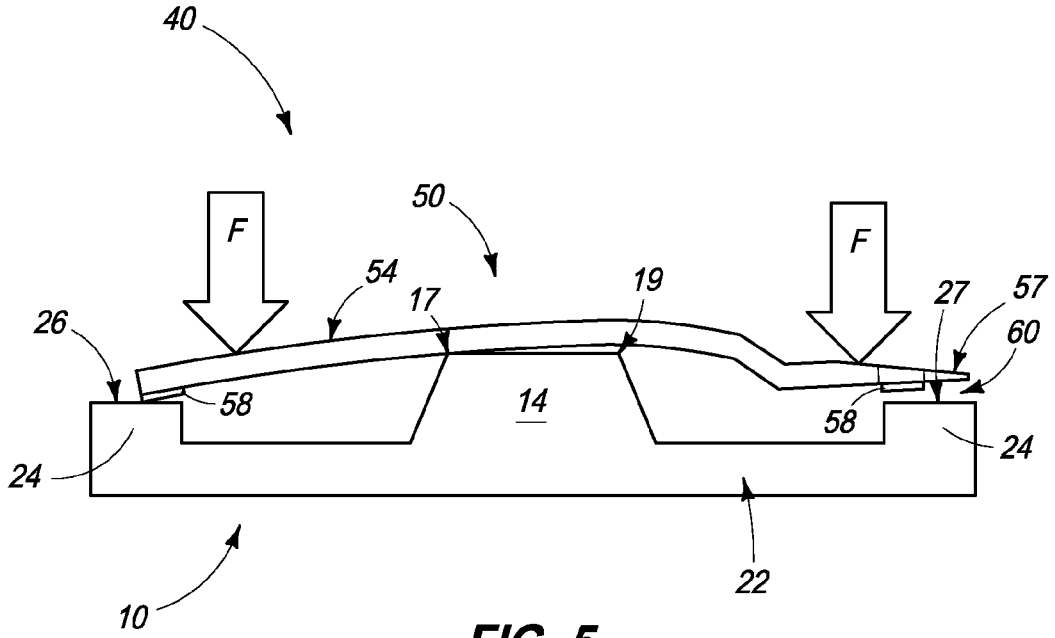
FIG. 5 illustrates a blade/support plate assembly in accordance with the support plate configuration depicted in FIG. 4.

Another aspect of the invention is described with reference to FIG. 4. As depicted, support plate 10 comprises raised feature 14, which can be referred to as a first raised feature. A second raised feature and a third raised feature 24 can be provided at a back edge 21 and front edge 20 of the support plate. Features 24 can be magnetic bars having upper surfaces 26 (back feature) and 27 (front feature). The magnetic bars can have the same or differing heights relative to one another. In particular instances, it can be preferable that both magnetic bars have heights below the height of first raised feature 14.

The shape of magnetic bars can be square or rectangular as illustrated. Alternatively, the bars can be rounded, have a rounded upper surface or can be alternately shaped (polygonal, etc.).

Example sizes for magnetic bars include a height of from 0.0625" to about 0.5". The length of the bars (along the width of the support plate) can be from about 0.125" to about 2.0". The height can be from about 0.0625" to about 0.5". The bars can be identical to each other or can be of differing sizes.

Magnetic bars 24 can provided to have surfaces 26 and 27 of like polarity or of opposite polarity based upon the desired effect. For example, with reference to FIG. 5, magnetic components 58 can be positioned on an underside of blade 50 near the front edge and at or near the back edge. Preferably, in assembly 40, surface 26 of back magnetic bar 24 is configured to attract the magnetic component 58 disposed at or near back end 21 of blade 50. This attraction force can contribute toward blade deflection and pre-tensioning of the blade.

Front magnetic surface 27 can also be configured to produce an attraction force between such surface and magnetic component 58 positioned beneath blade 50 near the front of the blade. This configuration may also assist in blade deflection to achieve a desired blade curvature. Alternatively, magnetic component near the front of the blade can be configured to produce a repelling force with respect to surface 27 of magnetic bar 24. This configuration may be beneficial in maintaining gap. Alternatively, magnetic components 58 can be omitted and surfaces 26 and 27 can interact directly with the proximate surfaces of blade 50 (shown in FIG. 6). Magnetic bars 24 can be utilized alone or in conjunction with one or more additionally applied forces.

In particular configurations one or both of magnetic bars 24 can be replaced with one or more magnetic discs (not shown). Appropriate sized disc can have a diameter of from about 0.125" to about 1.0". Disc thickness can be from about 0.0625" to about 0.5".

Figure 6:
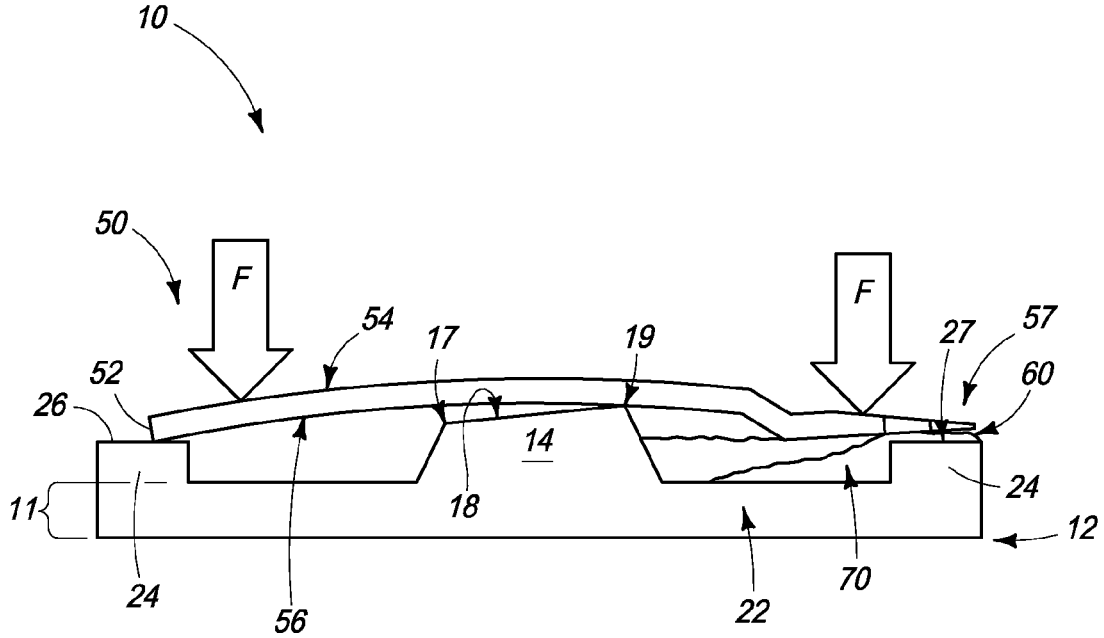
FIG. 6 depicts another embodiment of a blade/support plate assembly in accordance with the invention.

Referring next to FIG. 6, such illustrates optional aspects of the invention. As indicated, surfaces 26 and 27 of magnetic bars 24 can interact with proximate surfaces of blade 50. As further illustrated, surface 18 of raise feature 14 can be angled such that corner 17 is lower than corner 19. Alternatively, corner 17 can be higher than corner 19 such that the blade contacts corner 17 rather than corner 19. Such configurations can assist in creating a "fulcrum" such that the blade contacts raised feature 14 at only one position. Although depicted in conjunction with magnetic bars 24, angled surface 18 can be utilized in an absence of the magnetic bars.

An additional optional feature is the presence of an epoxy 70 (or similar material) which can be utilized for attachment of magnet (bars 24 and/or components 58). Epoxy 70 can be utilized to attach magnetic bars to the plate and/or attach magnetic components to blade 50.

Figure 7:
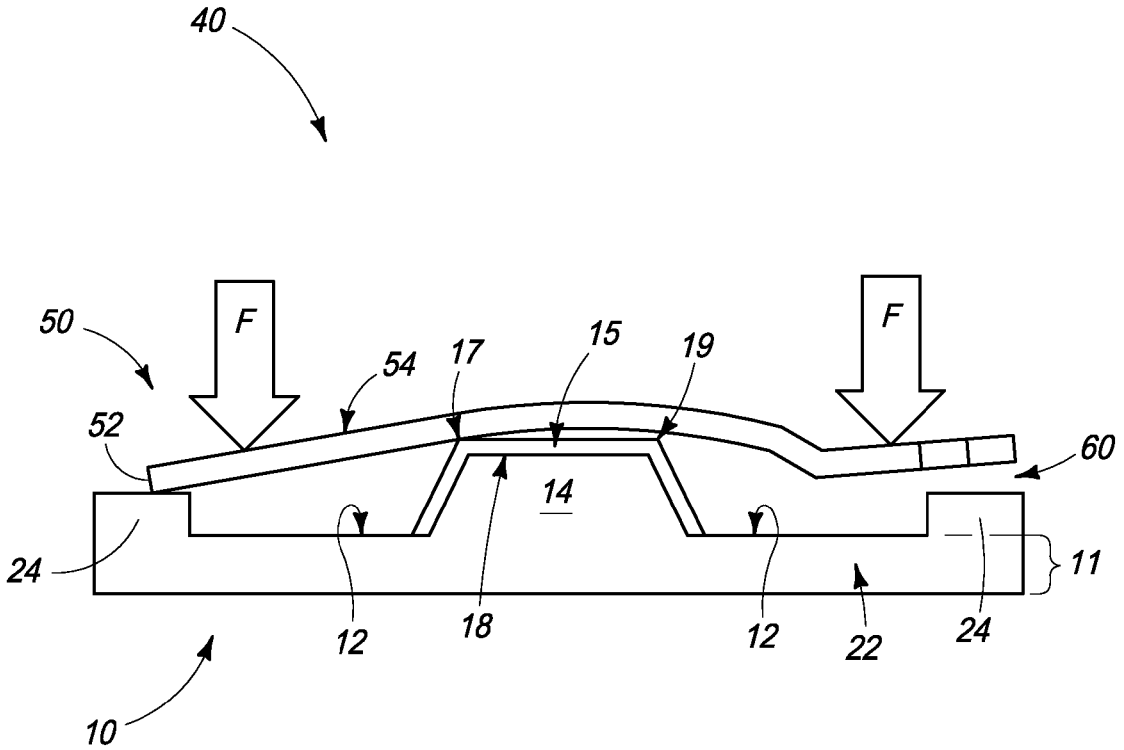
FIG. 7 illustrates an alternate configuration of the support plate according to one aspect of the invention

Referring to FIG. 7, raised feature 14 sidewalls 16 are comprised of the coating material. The coating material can differ from the remaining portion of raised feature 14. In particular aspects, coating material 15 may be present only along the upper surface. Such coating can be for example, rubber, plastic, or other material that can conform to the surfaces of the underlying portion of raised feature 14. In some instance, raised feature 14 can comprise a first material such as metal, metal alloy, wood, etc. Overlying coating material 15 can be provided to interface with blade 50 to conform to the curvature of the blade. Such coating material can be utilized in conjunction with any of the configurations of raised feature 14 described above.

Figure 8:
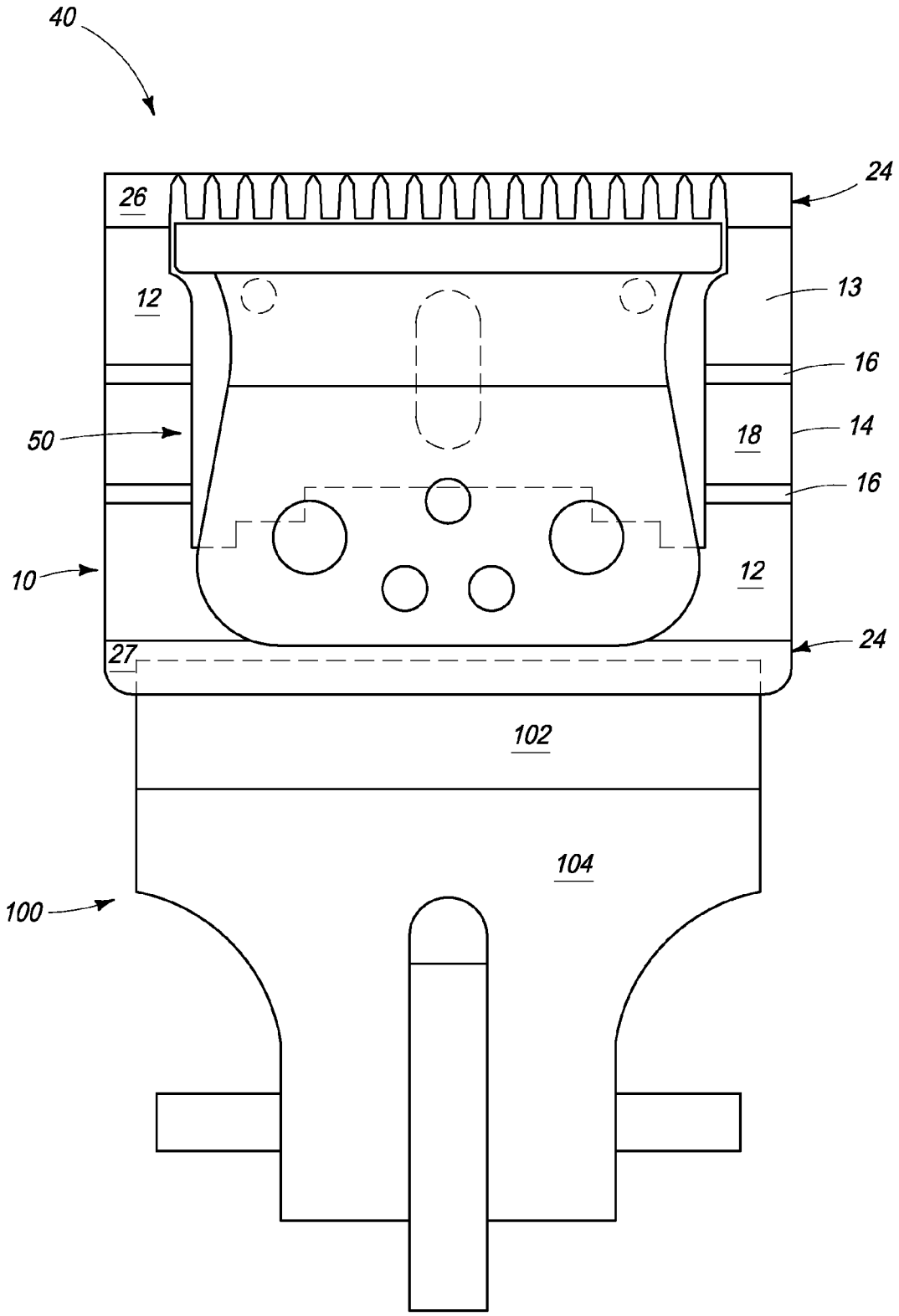
FIG. 8 depicts a blade/support plate assembly of the invention associated with a holder utilized in sharpening.

Systems utilizing the various blade/plate assemblies described above are presented with reference to FIGS. 8-9. Referring to FIG. 8, support plate/blade assembly 40 is shown in association with an example assembly holder 100. Holder 100 can be a conventional holder for use with a sharpening machine as illustrated, or can be an alternative holder for manual sharpening. Typically, the holder will have an attachment portion 102 for holding the support plate/blade assembly and a handle or arm portion 104 for manual applications or machine applications, respectively. In some applications, the plate/blade assembly can be held to holder 100 by magnetic forces. However, alternative means of attachment are contemplated. The shown configuration is for purposes of description purposes. The blade assemblies of the invention are compatible with a multitude of conventional holders.

Figure 9:
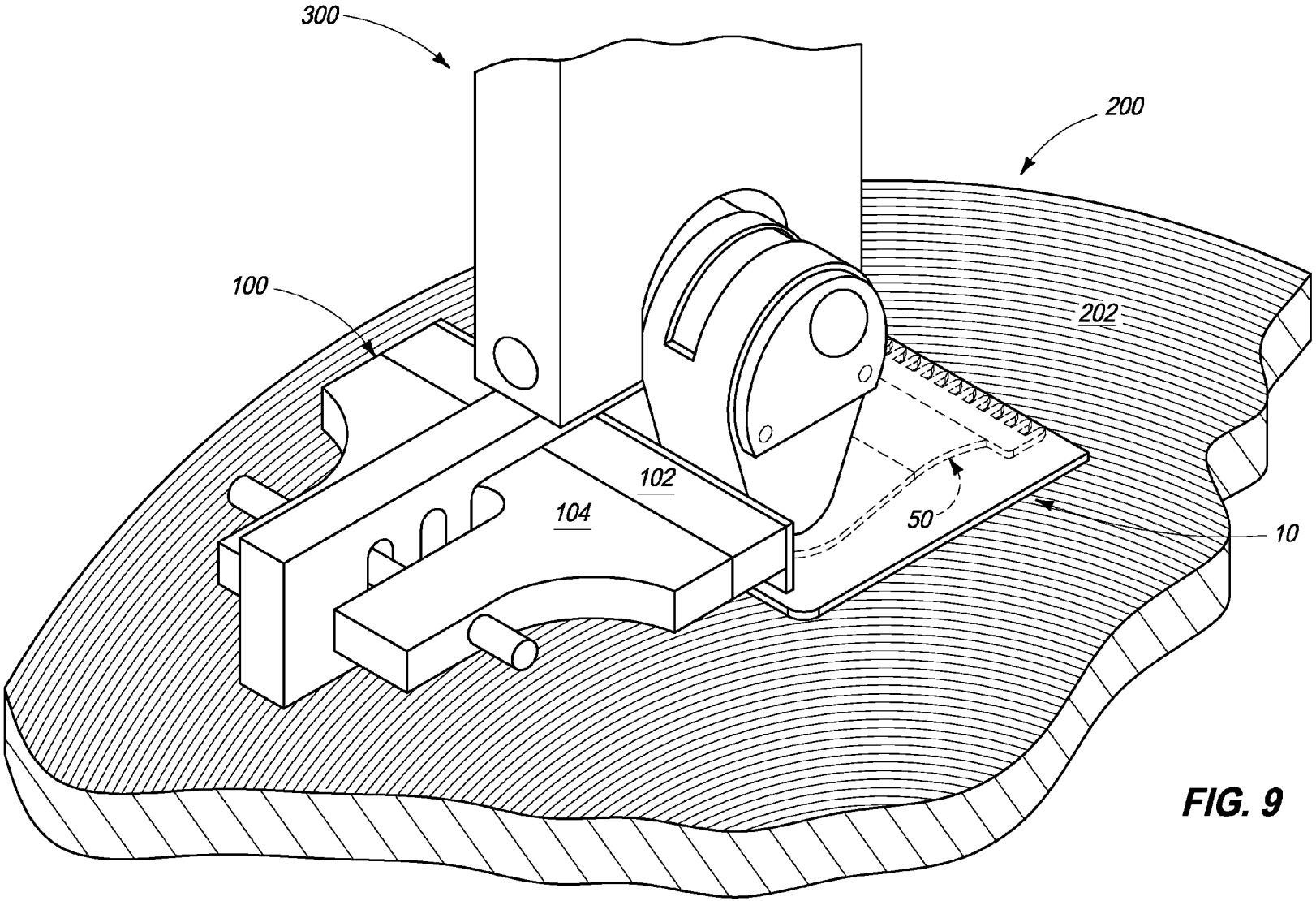
FIG. 9 depicts an example sharpening system utilizing the blade/support plate assembly in accordance with one aspect of the invention.

Referring next to FIG. 9, such depicts the holder and assembly of FIG. 8 in association with a mechanical sharpening device 300. Such device can attach to the holder 100 in an inverted position relative to FIG. 8. In this position, blade 50 can be applied to a sharpening surface 202 of a sharpening plate 200. It is noted that in the depiction of FIG. 9, the "upper" surface of the comb blade is contacted to the sharpening surface, where "upper surface" refers to the top of the blade as it is mounted within a clipper device. Where blade 50 is a cutter blade, the lower surface is applied to the sharpening surface, where "lower surface" refers to the bottom of the blade as it is mounted in the clipper device.

Sharpening plate 200 can preferably a rotating sharpening plate or disc. In some instances it can be preferable to utilize a sharpening disc having a crowned sharpening surface to produce a hollow grind. Sharpening surface 200 can be, for example, a lapping surface, a honing surface, a grinding surface and a polishing surface. In some aspects such as during polishing utilizing a polishing surface, an abrasive polishing media including but not limited to an abrasive slurry, fixed abrasive material, or loose abrasive material. Abrasive materials can be adhered to the sharpening surface utilizing an adhesive or a tacky non-hardening adhesive.

It is to be understood that the machine configuration of FIG. 9 is for description purposes only. The actual system can be any of many sharpening machines. Additionally, the holder with the attached assembly can be for manual sharpening where the blade is manually applied to the sharpening surface.

While contacting the blade to the polishing surface (either manually or mechanically), the support plate/blade assembly holds the blade under tension such that the blade is maintained in a pre-tensioned configuration as discussed above. The pre-tensioning of the blade in this manner can result in minimal heat generation during polishing, increased control of the metal removal rate and more consistent results as compared to conventional sharpening utilizing non-pre-tensioning of the blade since less pressure need be applied to the pre-tensioned blade. The curvature (or flattening) of the blade in the assemblies of the invention allows simulation of the tension and shape of the blade during use of the corresponding clipper or trimmer. Accordingly, excessive pressure during sharpening is not needed to simulate the blade in a clipper or trimmer assembly. The invention provides for less heat due to pressure and thereby produces less blade distortion. The resulting profile of the blade is therefore more precise for proper cutting when mounted in the trimmer or clipper device.

Methodology of the invention includes utilization of any of the support plates and support plate blade assemblies described herein. Specifically, the methods will include providing a support plate having a raised feature and positioning a clipper or trimmer blade over the support plate. Force is then applied to the blade to deflect the front and back of the blade toward the underlying plate. The raised feature contacts the underside of the blade at a single position creating a "fulcrum", such that the blade is held in a pre-tensioned configuration over the fulcrum. The blade is thereby pre-tensioned and is maintained in the pre-tensioned configuration during sharpening.

Sharpening is conducted by inverting the plate/blade assembly and contacting the blade to a lapping surface as described above. The sharpening process can be a manual process or can be mechanical. This methodology can produce a superior blade profile for proper function during clipping or trimming. Blades sharpened according to the invention will provide more precise and improved cutting ability as compared to conventionally sharpened blades.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A method of sharpening a hair clipper blade, the method comprising:

providing a hair clipper blade to be sharpened; pre-tensioning the hair clipper blade over a raised fulcrum of a support plate, a front edge and a back edge of the hair clipper blade being deflected toward the support plate prior to contacting a sharpening surface; and utilizing a holder, contacting the tensioned hair clipper blade with the sharpening surface and sharpening the hair clipper blade before the tension is released from the hair clipper blade.

2. The method of claim 1 wherein the front edge of the hair clipper blade is spaced from the plate by a gap.

3. The method of claim 1 wherein the sharpening surface is selected from the group consisting of a lapping surface, a honing surface, a grinding surface and a polishing surface.

4. The method of claim 1 wherein the sharpening comprises manual application of the hair clipper blade to the sharpening surface utilizing the holder.

5. The method of claim 1 wherein the holder is attached to a sharpening machine which provides contacting of the hair clipper blade with the sharpening surface.

6. The method of claim 1 wherein the pre-tensioning the hair clipper blade comprises:

positioning a first side of the hair clipper blade against the fulcrum; and applying force to the hair clipper blade over the fulcrum.

7. The method of claim 6 wherein the force is applied against a second side of the hair clipper blade.

8. The method of claim 6 wherein the force is a magnetic force applied to the first surface of the hair clipper blade.

9. The method of claim 6 wherein the applied force deflects the hair clipper blade over the fulcrum.

* * * * *